US011650022B2

(12) United States Patent
Rodriguez

(10) Patent No.: US 11,650,022 B2
(45) **Date of Patent: *May 16, 2023**

(54) SAFETY LATCH FOR SECURING MAGAZINE IN FIREARM

(71) Applicant: Ryan Rodriguez, Oceanside, CA (US)

(72) Inventor: Ryan Rodriguez, Oceanside, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/351,932

(22) Filed: Jun. 18, 2021

(65) Prior Publication Data

US 2022/0049915 A1 Feb. 17, 2022

Related U.S. Application Data

(63) Continuation of application No. 16/911,228, filed on Jun. 24, 2020, now Pat. No. 11,054,203.

(60) Provisional application No. 62/866,144, filed on Jun. 25, 2019.

(51) Int. Cl.
*F41A 17/38* (2006.01)

(52) U.S. Cl.
CPC ..... *F41A 17/38* (2013.01)

(58) Field of Classification Search
CPC ..... F41A 17/38
See application file for complete search history.

(56) References Cited

U.S. PATENT DOCUMENTS

| | | | | | |
|---|---|---|---|---|---|
| 2,386,722 | A * | 10/1945 | Sefried | F41A 17/38 | 89/138 |
| 4,580,363 | A * | 4/1986 | Rowe, Jr. | F41A 17/38 | 42/6 |
| 4,709,496 | A * | 12/1987 | Johnson | F41A 17/44 | 42/70.11 |
| 4,768,301 | A * | 9/1988 | Thomas | F41A 35/06 | 42/7 |
| 4,899,476 | A * | 2/1990 | Hindle | F41A 17/38 | 42/7 |
| 6,141,895 | A * | 11/2000 | Rost | F41A 35/06 | 42/6 |
| 8,104,209 | B1 * | 1/2012 | Bentley | F41A 9/59 | 42/6 |
| 10,378,840 | B1 * | 8/2019 | Huang | F41A 9/59 | |
| 10,473,414 | B1 * | 11/2019 | Curry | F41A 35/06 | |
| 10,495,399 | B1 * | 12/2019 | Dalessio | F41A 17/38 | |
| 10,690,426 | B1 * | 6/2020 | Huang | F41A 9/59 | |
| 10,753,696 | B1 * | 8/2020 | Christopher | F41A 17/42 | |
| 2006/0096145 | A1 * | 5/2006 | Gussalli Beretta | F41A 17/38 | 42/50 |
| 2006/0123683 | A1 * | 6/2006 | Garrett | F41A 17/38 | 42/6 |
| 2014/0290637 | A1 * | 10/2014 | Maeda | F41A 17/38 | 124/74 |

(Continued)

*Primary Examiner* — Derrick R Morgan
(74) *Attorney, Agent, or Firm* — Lewis Kohn & Walker LLP; David M. Kohn; Kari Moyer-Henry

(57) ABSTRACT

A mechanism for preventing a partially inserted magazine from accidently ejecting from the firearm. The improved firearms include any type of projectile weapon that employs a magazine to provide ammunition and include rifles and pistols. An improved magazine catch that includes both the primary latch and a safety latch. A method for engaging a magazine to a firearm for providing the firearm with ammunition without unintentionally dropping the magazine due to incomplete insertion.

12 Claims, 8 Drawing Sheets

(56) References Cited

U.S. PATENT DOCUMENTS

| | | | | |
|---|---|---|---|---|
| 2014/0325886 | A1* | 11/2014 | Mather | F41A 17/38 42/6 |
| 2015/0330736 | A1* | 11/2015 | Love | F41A 5/02 42/16 |
| 2017/0160026 | A1* | 6/2017 | Walther | F41A 17/38 |
| 2017/0199000 | A1* | 7/2017 | Paquette | F41A 17/38 |
| 2017/0227312 | A1* | 8/2017 | Christensen | F41A 9/66 |
| 2018/0156556 | A1* | 6/2018 | Wyssen | F41A 35/06 |
| 2018/0156557 | A1* | 6/2018 | Abbott | F41A 17/38 |
| 2019/0139353 | A1* | 5/2019 | Barnum | A21D 13/41 |
| 2019/0212085 | A1* | 7/2019 | Wilkinson | F41A 3/66 |
| 2020/0248977 | A1* | 8/2020 | Maldonado | F41A 11/00 |
| 2020/0408476 | A1* | 12/2020 | Rodriguez | F41A 17/38 |
| 2022/0034612 | A1* | 2/2022 | Kasanjian-King | F41A 11/00 |

* cited by examiner

SAFETY LATCH FOR SECURING MAGAZINE IN FIREARM

RELATED APPLICATIONS

This application is a continuation which claims the benefit of priority from U.S. patent application Ser. No. 16/911,228 filed Jun. 24, 2020, which claims the benefit of priority from U.S. Provisional Patent Application No. 62/866,144 filed Jun. 25, 2019.

BACKGROUND

Many firearms employ detachable ammunition magazines. When in use, the magazine is inserted into a magazine well within the firearm and retained therein by a catch having a latch which engages a keeper defined a recess within the magazine. A firearm having an exemplary magazine retention catch is disclosed in U.S. Pat. No. 8,943,866 (Fernandez), incorporated herein by reference. When the ammunition within a magazine is spent, the catch is released by depression of a release button which lifts the latch from the recess of the magazine keeper and disengages the magazine from the magazine well. The magazine is then ejected from the firearm by falling due to the force of gravity. The spent magazine is then exchanged for a new magazine.

During firearm competitions, several magazines may be employed. One measure of the competition is the rapidity with which the firearm is employed. Rapidity may be enhanced by engaging and disengaging ammunition magazines as quickly as possible as the magazines are spent.

Unfortunately, because of the tight fit of the magazine within the magazine well, a magazine can sometimes appear to be fully engaged within the firearm, when, in fact, it is not. This can result in an unengaged magazine spontaneously dropping from the magazine well, due to gravity. From a competition point of view, this is disadvantageous because of the lost time spent retrieving the magazine.

A prior art firearm that employs a magazine is disclosed in U.S. Pat. No. 9,010,006 (Michel), incorporated herein by reference. FIG. 3 of Michel illustrates the insertion of a magazine into a magazine well. FIGS. 4 and 5 illustrate the engagement of a latch (Ref 46) with the magazine.

The problem is that sometimes, when loading the magazine into the magazine well, the latch does not fully engage the recess in the magazine. However, the magazine may appear to the user to be secure within the magazine well because of its tight fit, when, in fact, it is not. When this happens, there is a risk that the magazine may simply drop from the firearm.

What was needed was a magazine retention mechanism that employed a conventional latch for securing a magazine within a magazine well when the magazine is fully engaged with the firearm, but also includes a backup latch mechanism for securing a magazine within a magazine well when the magazine is not fully engaged with the firearm. The backup latch mechanism should serve to prevent the magazine from unintentionally ejecting from the magazine well when the magazine is only partially engaged to the firearm. In this event, ammunition within the magazine will be unemployable due to the incomplete engagement within the magazine well, but the magazine itself will not be ejected from the magazine well. As soon as the user realizes this error, the user will re-secure the magazine within the well. But, in the meantime, because of the backup latch, the magazine will not drop from the firearm.

SUMMARY

The invention is directed to an improved firearm (2). The invention is directed to a mechanism for preventing a partially inserted magazine (4) from accidently ejecting from the firearm (2). The improved firearms (2) include any type of projectile weapon that employs a magazine (4) to provide ammunition and include rifles and pistols.

The firearm (2) is of a type that employs a magazine (4) for supplying the firearm (2) with ammunition. The magazine (4) is first loaded with ammunition before it is inserted into the firearm (2). The magazine (4) includes a keeper (6) to which the firearm (2) may engage for securing the magazine (4) thereto.

The firearm (2) is of a type that includes a receiver (8) that includes a magazine well (10). The magazine well (10) defines a cavity (12) into which the magazine (4) may be inserted and from which the magazine (4) may be ejected. A magazine catch (14) is incorporated into the receiver (8) and protrudes into the cavity (12) of the magazine well (10) for engaging the magazine keeper (6) when the magazine (4) is fully inserted into the magazine well (10). The magazine catch (14) retains the magazine (4) therein for supplying ammunition to the firearm (2). The magazine catch (14) may be disengaged from the magazine keeper (6) for ejecting the magazine (4) from the magazine well (10).

The magazine catch (14) includes a primary latch (16), a spring (18), and a magazine release button (20). The spring (18) is coupled to the magazine catch (14) for urging the primary latch (16) into the magazine well (10). When the magazine (4) is fully inserted into the magazine well (10), the spring (18) urges the primary latch (16) into the keeper (6) on the magazine (4) for coupling to and retaining the fully inserted magazine (4) within the magazine well (10) and engaging the magazine (4) therein for supplying the firearm (2) with ammunition.

The magazine release button (20) is mechanically coupled to the primary latch (16).

Depressing the magazine release button (20) serves to overcome the spring (18) and causes the primary latch (16) to retract from the keeper (6) on the magazine (4) and disengages the primary latch (16) from the magazine keeper (6). Retracting the primary latch (16) from the keeper (6) on the magazine (4) disengages the magazine (4) from the firearm (2) and allows the magazine (4) to eject from the magazine well (10).

More particularly, the invention is directed to an improved magazine catch (14) that includes both the primary latch (16) and a safety latch (22). Like the primary latch (16), the safety latch (22) is incorporated into the magazine catch (14) and is coupled thereby to the spring (18). The spring (18) urges the safety latch (22) into the magazine well (10).

When the magazine (4) is inserted into the magazine well (10), the spring (18) urges the safety latch (22) onto the magazine (4). If the magazine (4) is partially inserted into the magazine well (10) so as to align the safety latch (22) with the magazine keeper (6), then the spring (18) will urge the safety latch (22) onto the magazine keeper (6), so as to couple magazine catch (14) to the magazine (4) and retain the magazine (4) within the magazine well (10). When the safety latch (22) is coupled to the magazine keeper (6), the magazine (4) is secure within the magazine well (10) but is not engaged to the firearm (2) for supplying ammunition to the firearm (2). Like the primary latch (16), the safety latch (22) is also mechanically coupled to the magazine release button (20), via the catch (14). If the magazine release button (20) is depressed while the safety latch (22) is coupled to the magazine keeper (6), the magazine release button (20) will overcome the spring (18) and will cause the safety latch (22) to retract from the magazine keeper (6) for decoupling the magazine catch (14) from the magazine, allowing the magazine (4) to eject from the magazine well (10).

The invention is further directed to a method for engaging a magazine (4) to a firearm (2) for providing the firearm (2) with ammunition without unintentionally dropping the magazine (4) due to incomplete insertion. More particularly, the method comprises two steps. In the first step, the user inserts the magazine (4) into a magazine well (10) of the firearm (2) until a magazine keeper (6) on the magazine (4) is engaged by a safety latch (22) of a magazine catch (14) within the firearm (2) for securing the magazine (4) to the firearm (2). The first step is performed without engaging the magazine (4) to the firearm (2) for providing ammunition. Then in the second step, the user continues to insert the magazine (4) into the magazine well (10) of the firearm (2) until the magazine keeper (6) on the magazine (4) is engaged by a primary latch (16) of the magazine catch (14) within the firearm (2) for further securing the magazine (4) to the firearm (2). During the second step, the magazine (4) is engaged to the firearm (2) for providing ammunition thereto. The engagement of the safety latch (22) to the magazine keeper (6) in the first Step prevents the magazine (4) from unintentionally dropping from the magazine well (10) in the event of incomplete insertion of the magazine (4) into the magazine well (10) in the second Step.

BRIEF DESCRIPTION OF FIGURES

FIG. 1 A illustrates the firearm prior to the insertion of the magazine.

FIG. 1 B illustrates the firearm of FIG. 1 A, rotated 180 degrees about a vertical axis, showing the magazine partially inserted by a user into the magazine well, without engaging either the primary latch or the safety latch therein.

FIG. 1 C illustrates the firearm of FIG. 1 B showing the magazine being further inserted by the user into the magazine well, transitioning the engagement of the magazine within the magazine well from the safety latch to the primary latch. When engaged by the safety latch within the magazine well, the magazine is secure within the well, but the ammunition within the magazine is not employable by the firearm. When engaged by the primary latch within the magazine well, the magazine is secure within the well and the ammunition therein is employable by the firearm.

FIG. 1 D illustrates the firearm of FIG. 1 C showing the user releasing the magazine from the magazine well by activating a release button on the firearm for disengaging both the primary and safety latches from engagement with the magazine.

FIG. 2 B illustrates an enlarge perspective view of the magazine catch of FIG. 2 A showing the primary latch and safety latch in greater detail.

FIG. 3 A illustrates a fragmentary perspective view of the magazine of FIG. 2 A enlarged and rotated clockwise ninety degrees about a vertical axis. In FIG. 3 A, the magazine has not yet been inserted into the magazine well.

FIG. 3 B illustrates a fragmentary perspective view of the magazine of FIG. 3 A after the magazine has been partially inserted into the magazine well. FIG. 3 B further illustrates that, when the magazine is initially inserted into the magazine well, the safety latch of the magazine catch contacts the magazine, but does not engage with the magazine keeper. In this configuration, the magazine is not secured within the magazine well.

FIG. 3 C illustrates a fragmentary perspective view of the magazine of FIG. 3 B after the magazine has been further inserted into the magazine well. In FIG. 3 C the safety latch of the magazine catch has engaged the magazine keeper, but the primary latch has not engaged the magazine keeper. In this configuration, the magazine is secured within the magazine well, but ammunition within the magazine is not employable by the firearm.

FIG. 3 D illustrates a fragmentary perspective view of the magazine of FIG. 3 C after the magazine has been fully inserted into the magazine well. In FIG. 3 D the primary latch of the magazine catch has engaged the magazine keeper. In this configuration, the magazine is secured within the magazine well and ammunition within the magazine is employable by the firearm.

FIG. 4 A illustrates a fragmentary sectional view of the magazine and magazine well of FIG. 1 B enlarged and rotated clockwise ninety degrees about a vertical axis. FIG. 4 A shows that, when the magazine is initially inserted into the magazine well, the safety latch of the magazine catch does not contact the magazine and does not engage with the magazine keeper. In this configuration, the magazine is not secured within the magazine well and ammunition within the magazine is not employable by the firearm.

FIG. 4 B illustrates a fragmentary sectional view of the magazine of FIG. 4 A after the magazine has been further inserted into the magazine well. FIG. 4 B shows that, when the magazine is further inserted into the magazine well, the safety latch of the magazine catch contacts the magazine but does not engage with the magazine keeper. In this configuration, the magazine is not secured within the magazine well and ammunition within the magazine is not employable by the firearm.

FIG. 4 C illustrates a fragmentary sectional view of the magazine of FIG. 4 B after the magazine has been yet further inserted into the magazine well. In FIG. 4 C the safety latch of the magazine catch has engaged the magazine keeper, but the primary latch has not engaged the magazine keeper. In this configuration, the magazine is secured within the magazine well, but ammunition within the magazine is not employable by the firearm.

FIG. 4 D illustrates a fragmentary sectional view of the magazine of FIG. 4 C after the magazine has been fully inserted into the magazine well. In FIG. 4 D the primary latch of the magazine catch has engaged the magazine keeper. In this configuration, the magazine is secured within the magazine well and ammunition within the magazine is employable by the firearm.

FIG. 4 E illustrates a fragmentary sectional view of the magazine of FIG. 4 D after the magazine has been released from the magazine well. In FIG. 4 E, the user has disengaged the primary latch of the magazine catch from the magazine keeper by depressing the magazine release button. In this configuration, the magazine is ejected from the magazine well by the action of gravity.

DETAILED DESCRIPTION

Figure 1A:
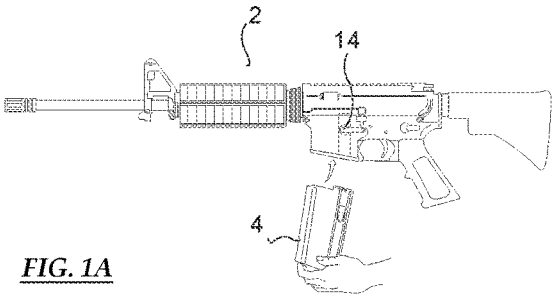
FIGS. 1 A-D illustrate a series of plan views showing a process for loading and releasing a magazine into and from a firearm of a type having a magazine well and having both a primary latch and a safety latch for retaining the magazine within the magazine well.
Figure 1B:
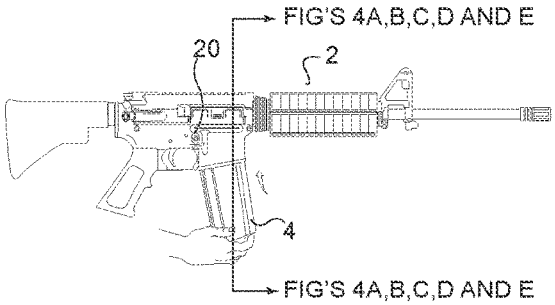
Figure 1C:
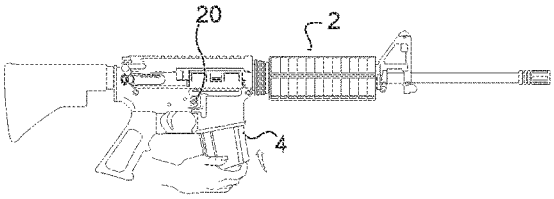
Figure 1D:
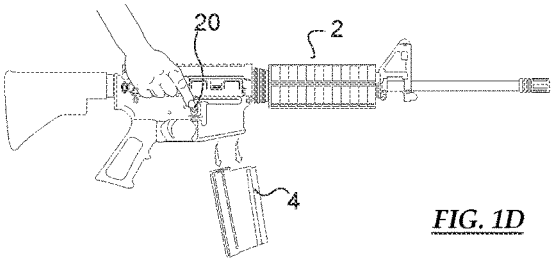

A generic process for loading a magazine (4) into the magazine well (10) of a firearm (2) and releasing it therefrom is illustrated in FIGS. 1 A-D. Initially, the firearm (2) has no magazine (4), as illustrated in FIG. 1 A. Then, the user begins to insert the magazine (4) into the cavity (12) defined by a magazine well (10), as illustrated in FIG. 1 B. The user then fully inserts the magazine (4) into the magazine well (10) by giving the magazine (4) a forceful push to engage the magazine (4) to the firearm (2) for the purpose of supplying ammunition to the firearm (2). As illustrated in FIG. 1 C, the user is sometimes uncertain at this stage whether or not the magazine (4) is secure within the magazine well (10) and the ammunition therein is employable by the firearm (2). If the magazine (4) is not secure within the magazine well (10) at this stage, there is a risk that the magazine (4) can spontaneously fall from the magazine well (10). It is the purpose of the present invention to reduce that risk. Once the magazine (4) is engaged to the firearm (2), it may then be ejected by the user from the magazine well (10) by pressing the magazine release button (20), as illustrated in FIG. 1 D.

The use of the safety latch (22) for securing the magazine (4) within the magazine well (10) during the magazine (4) insertion and release processes is illustrated in detail in FIGS. 3 A-D and FIGS. 4 A-E. When the magazine (4) is initially inserted into the magazine well (10), the safety latch (22) of the magazine catch (14) contacts the magazine (4), but does not engage with the magazine keeper (6), as illustrated in FIGS. 3 B and 4 B. In this configuration, the magazine (4) is not secured within the magazine well (10) and ammunition within the magazine (4) is not employable by the firearm (2). After the magazine (4) has been further inserted into the magazine well (10), the safety latch (22) of the magazine catch (14) engages the magazine keeper (6), as illustrated in FIGS. 3 C and 4 C. In this configuration, the primary latch (16) does not engage the magazine keeper (6). In this configuration, the magazine (4) is secured within the magazine well (10), but ammunition within the magazine (4) is not employable by the firearm (2). After the magazine (4) has been fully inserted into the magazine well (10), the primary latch (16) of the magazine catch (14) engages the magazine keeper (6), as illustrated in FIGS. 3 D and 4 D. In this configuration, the magazine (4) is secured within the magazine well (10) and ammunition within the magazine (4) is employable by the firearm (2).

Depressing the magazine release button (20) causes both the primary latch (16) and safety latch (22) to decouple from the magazine keeper (6) and disengage the magazine (4) from the magazine well (10), as illustrated in FIG. 4 E. In this configuration, the magazine (4) is ejected from the magazine well (10) by the action of gravity.

Figure 2A:
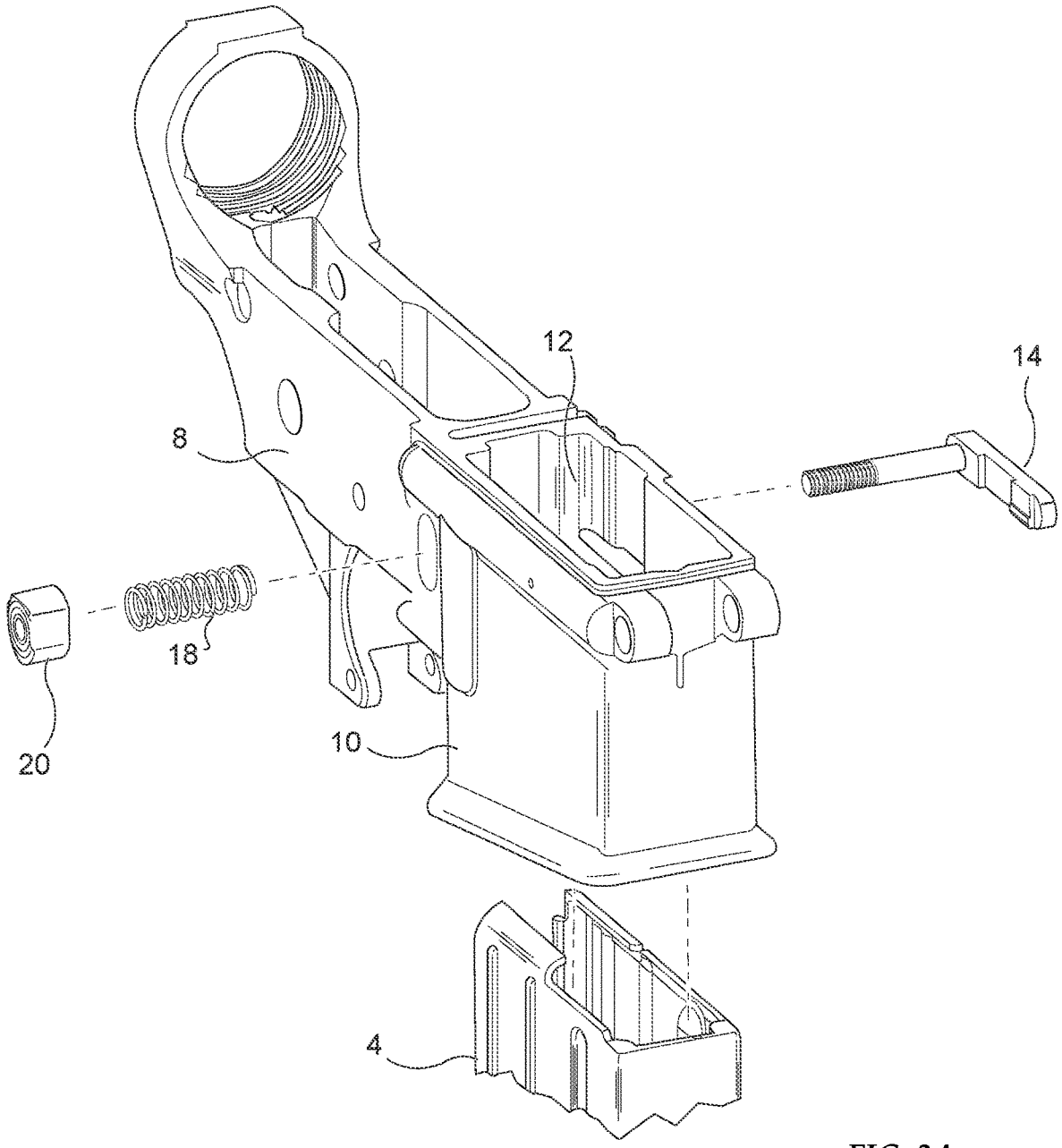
FIG. 2 A illustrates a perspective view showing the receiver, a fragment of the magazine, and an exploded view of the magazine catch, spring, and magazine release button of the firearm of FIG. 1 B.
Figure 2B:
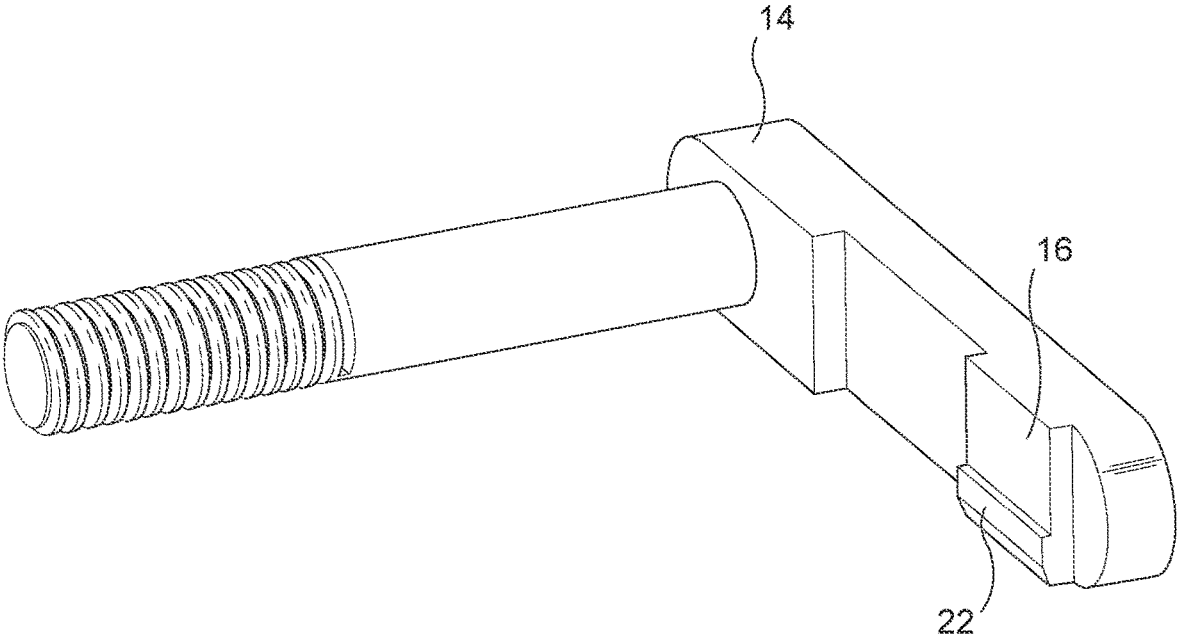
Figure 3A:
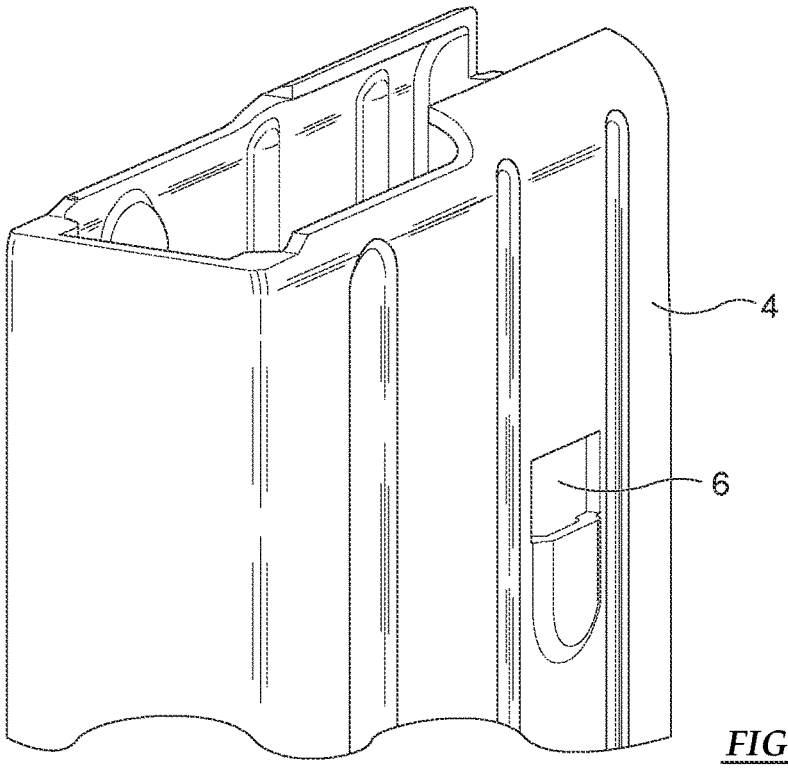
FIGS. 3 A-D illustrate a series of fragmentary perspective views showing the process of engaging the primary latch and safety latch with the magazine as the magazine is inserted into the magazine well.
Figure 3B:
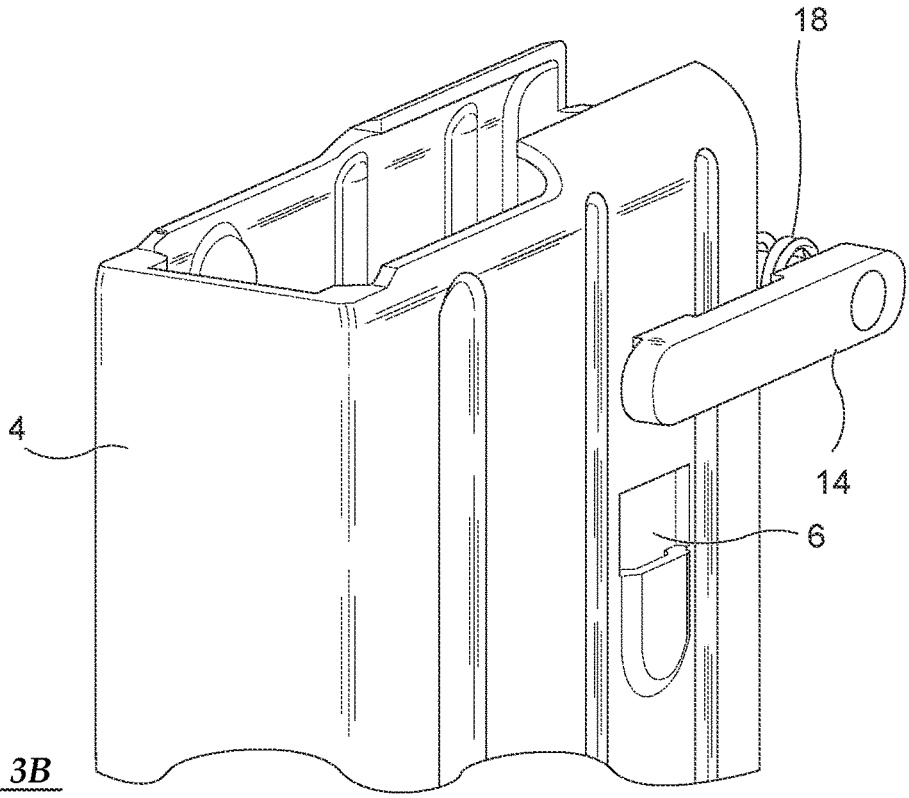
Figure 3C:
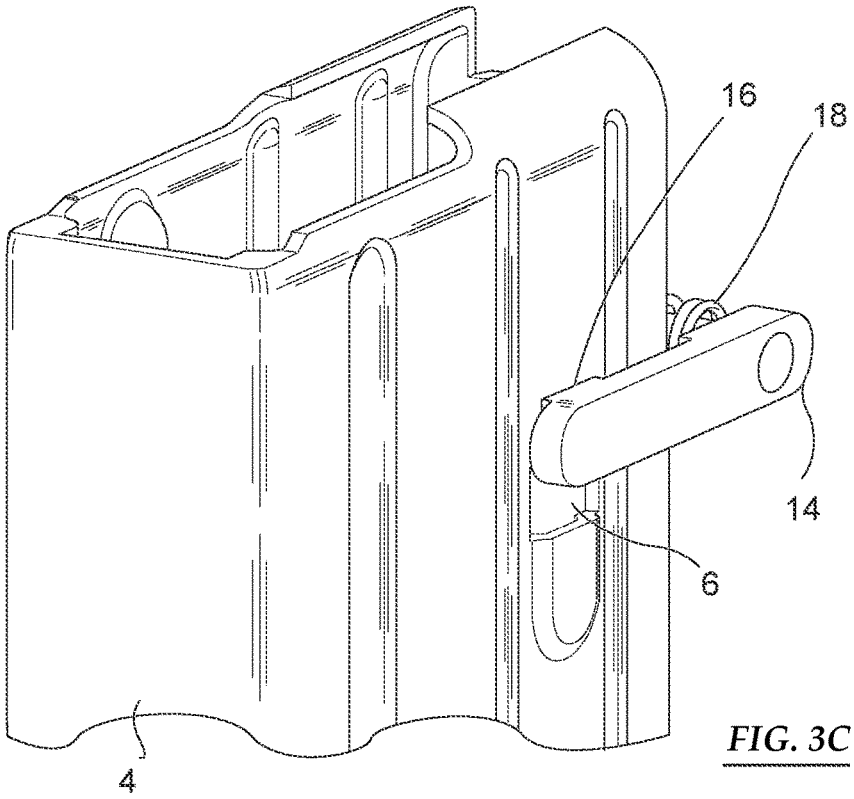
Figure 3D:
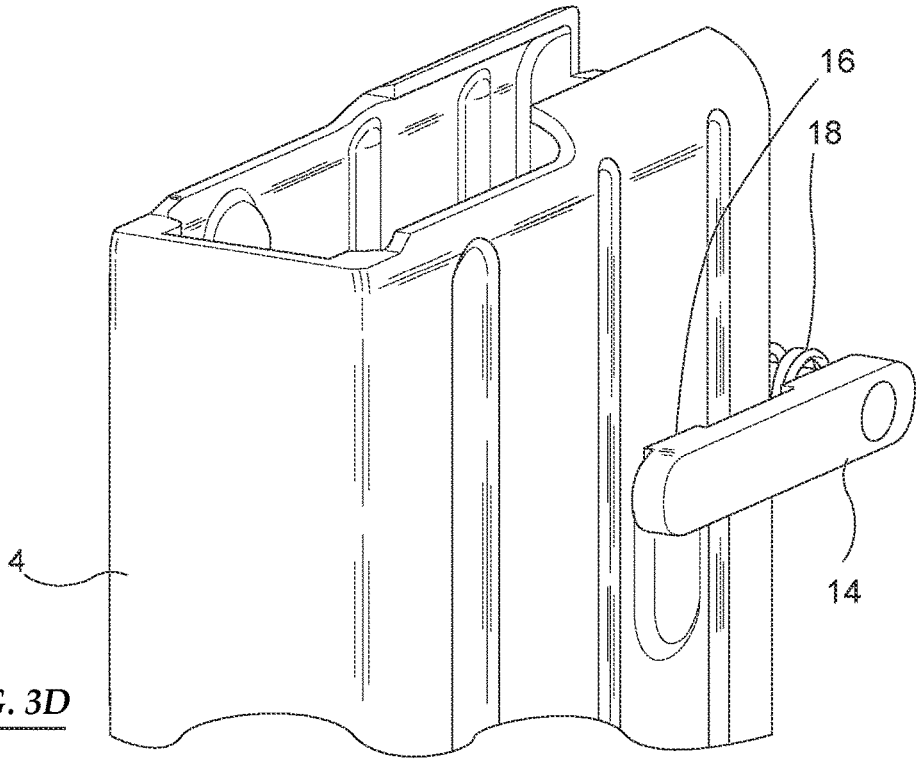
Figure 4A:
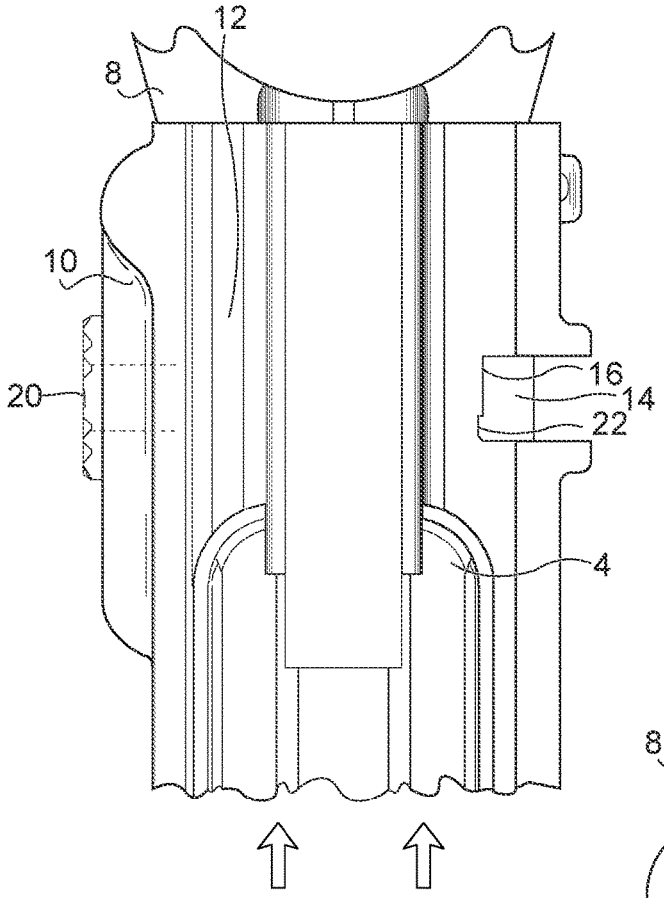
FIGS. 4 A-E illustrate a series of fragmentary sectional views showing the process of engaging and disengaging the primary latch and the safety latch to and from the magazine keeper as the magazine is inserted into the magazine well and released therefrom.
Figure 4B:
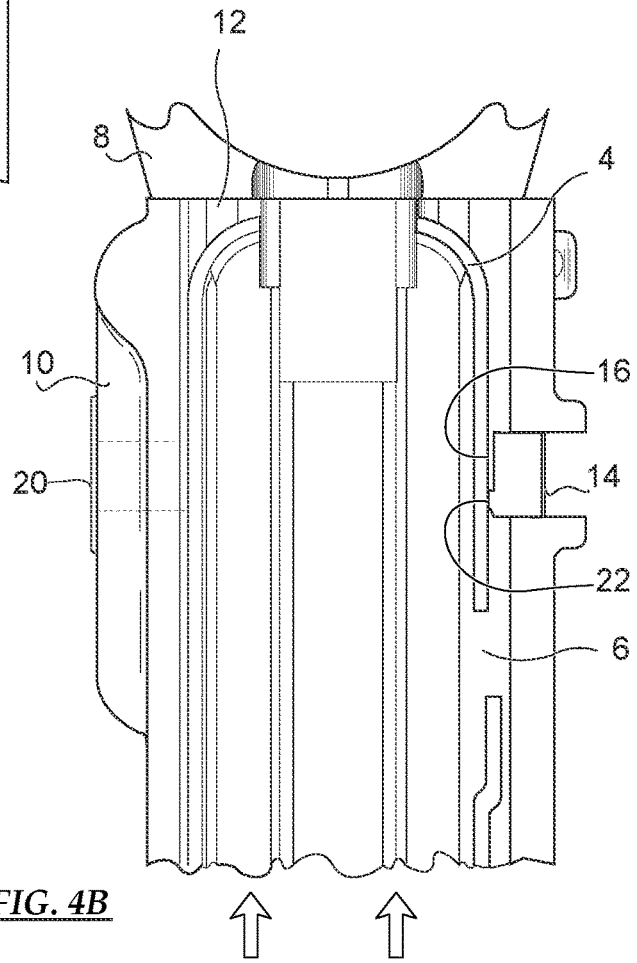
Figure 4C:
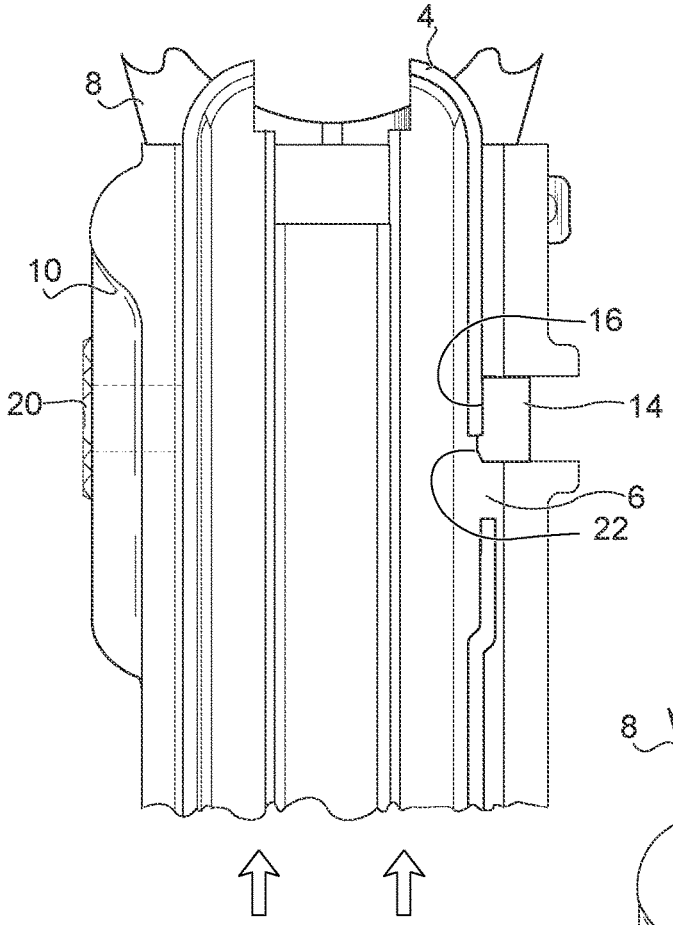
Figure 4D:
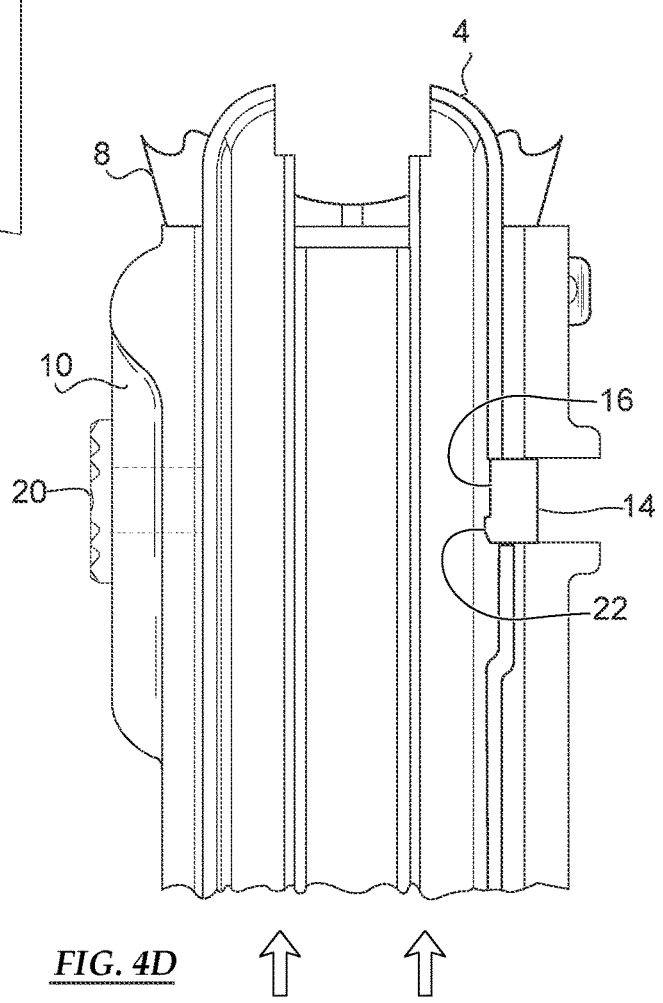
Figure 4E:
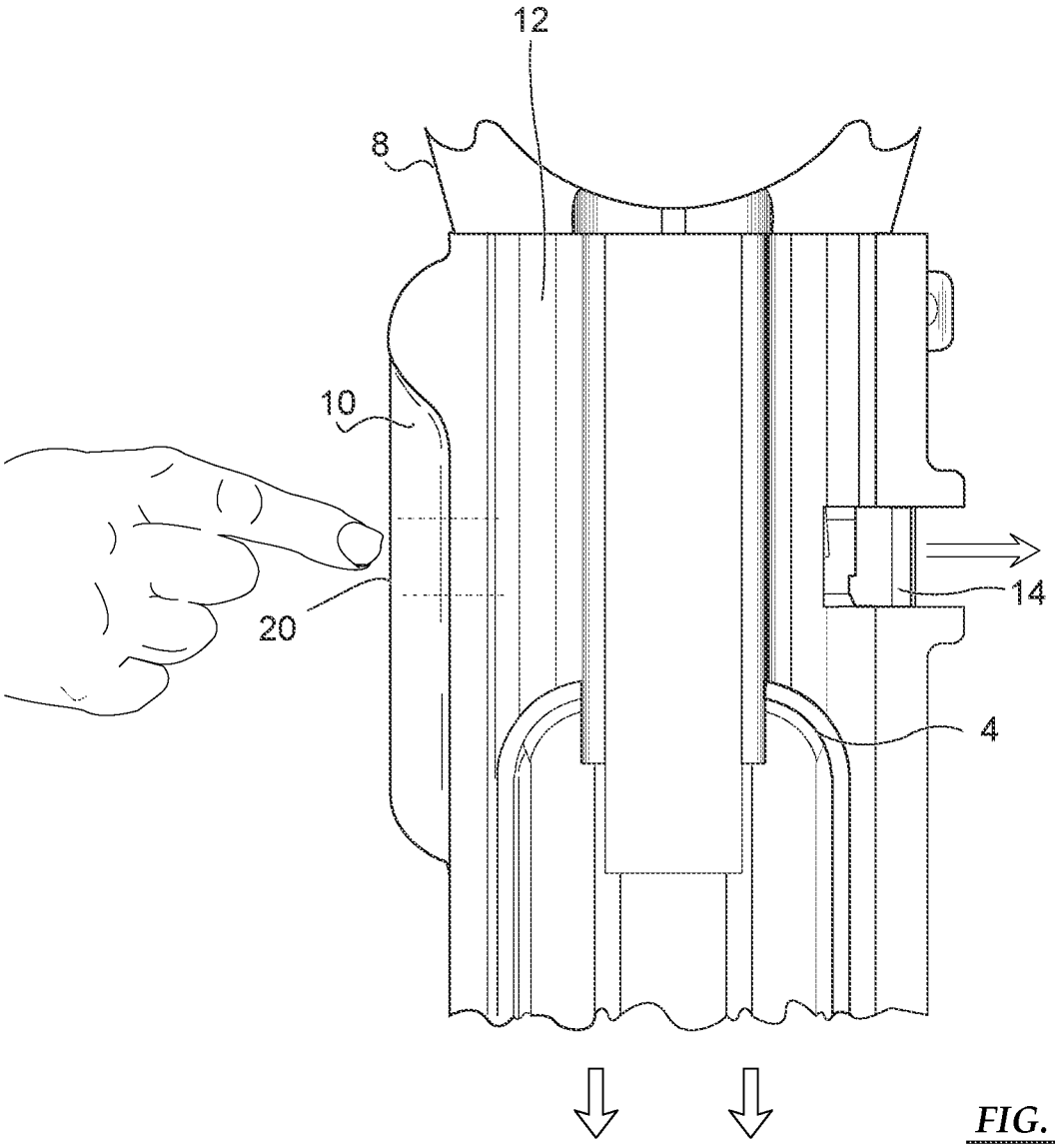

An exploded view of the magazine catch (14) to which the primary latch (16) and safety latch (22) are attached is illustrated in FIG. 2 A. The magazine catch (14) is incorporated into the receiver (8) and includes a catch spring (18) for biasing the catch (14) and a magazine release button (20) for counteracting the spring (18) and reversing the bias of the catch (14). An enlarge view of the primary latch (16) and safety latch (22) are illustrated in FIG. 2 B. The safety latch (22) is located below the primary latch (16) on the catch (14) and protrudes further from the catch (14) than does the primary latch (16). The location and extra height of the safety latch (22) allows the safety latch (22) to couple with the magazine keeper (6) when the magazine (4) is not fully inserted into the magazine well (10) for securing the magazine (4) therein.

What is claimed is:

1. A magazine catch for securing an ammunition magazine, the magazine catch including:

a primary latch, a spring coupled to the magazine catch for urging the primary latch into a keeper on a magazine well, a magazine release button mechanically coupled to the primary latch, and a secondary latch wherein the secondary latch protrudes from the primary latch and when the secondary latch is coupled to the magazine keeper, the magazine is secure within the magazine well but not engaged to the firearm for supplying ammunition to the firearm; and wherein the primary latch engages the magazine keeper, when the magazine is fully inserted into the magazine well.

2. The magazine catch of claim 1, wherein when the magazine is fully inserted into the magazine well the spring biases the catch and the magazine release button counteracts the spring and reverses the bias of the catch.

3. The magazine catch of claim 1, wherein the magazine release button, when depressed, overcomes the spring and retracts the primary latch from the keeper on the magazine well thereby disengaging the magazine catch from the magazine and releasing and removing the magazine from the magazine well.

4. The magazine catch of claim 1, wherein the spring urges said secondary latch into the magazine well and is mechanically coupled to the magazine release button for retracting the secondary latch from the magazine well.

5. The magazine catch of claim 1, wherein when the magazine is less than fully inserted into the magazine well the spring urges the secondary latch into the keeper wherein the secondary latch couples and retains the less than fully inserted magazine within the magazine well.

6. A retention mechanism for retaining an ammunition magazine in a firearm, the retention mechanism including:

a receiver for a firearm wherein the receiver includes a magazine well, and a magazine catch incorporated into the receiver wherein the magazine catch further includes a spring, a release button, a primary latch and a secondary latch wherein the secondary latch protrudes from the primary latch and when the secondary latch is coupled to the magazine well the magazine is secure within the magazine well but not engaged to the firearm for supplying ammunition to the firearm; and wherein the primary latch engages the magazine keeper when the magazine is fully inserted into the magazine well.

7. The retention mechanism of claim 6, wherein the magazine well defines a cavity into which the magazine may be inserted and ejected from and further includes a keeper.

8. The retention mechanism of claim 6, wherein the primary latch protrudes into the cavity of the magazine well.

9. The retention mechanism of claim 6, wherein the spring urges the primary latch into the keeper on the magazine well.

10. The retention mechanism of claim 6, wherein the secondary latch protrudes into the cavity of the magazine well and engages the magazine keeper when the magazine is partially inserted into the magazine well.

11. The retention mechanism of claim 6, wherein the spring urges the secondary latch into the keeper on the magazine well.

12. The retention mechanism of claim 6, wherein the magazine catch is mechanically coupled to the magazine release button wherein depressing the release button overcomes the spring and retracts the primary latch and the secondary latch from the magazine keeper.

* * * * *